United States Patent [19]

Bell

[11] 4,011,614

[45] Mar. 15, 1977

[54] ADJUSTABLE FLOATATION BELT

[75] Inventor: Robert Bell, Campbell, Calif.

[73] Assignee: Lawrence Peska Associates, Inc., New York, N.Y. ; a part interest

[22] Filed: Oct. 21, 1975

[21] Appl. No.: 624,378

[52] U.S. Cl. ..... 9/337; 9/319

[51] Int. Cl.[2] ..... B63C 9/18

[58] Field of Search ..... 9/311, 314, 319, 329, 9/336, 337, 338, 340

[56] References Cited

UNITED STATES PATENTS

| | | | |
|---|---|---|---|
| 741,526 | 10/1903 | Mitchell | 9/314 |
| 1,236,310 | 8/1917 | Johnson | 9/336 |
| 2,716,245 | 8/1955 | Desjarlais et al. | 9/336 |
| 2,869,151 | 1/1959 | Johnson | 9/340 |
| 2,895,147 | 7/1959 | Desjarlais et al. | 9/319 |
| 3,119,132 | 1/1964 | Nayar | 9/337 |

*Primary Examiner*—Trygve M. Blix
*Assistant Examiner*—Stuart M. Goldstein

[57] ABSTRACT

A water safety belt is disclosed which comprises in one embodiment an adjustable flotation belt having at least two inflatable pouches which are releasably securable to one another at one end through tube members connected to the pouches and which are joinable through a coupling. An inflation device is provided to inflate the pouches through the tube members when the tubes are joined. The ends of the pouches which are not joined by the tubes have an adjustable strap secured thereto for increasing and decreasing the waist size of the belt. The belt is adapted to be worn around/wading boots that are at least waist high whereby the belt can be used to seal the boots to the waist of a person wearing them and to thereby prevent water from entering the boots.

10 Claims, 4 Drawing Figures

ADJUSTABLE FLOATATION BELT

SUMMARY OF THE INVENTION

The present invention relates to a water safety belt adapted to be worn around the waist of a person and comprises a first pneumatogenic member and a second pneumatogenic member the pneumatogenic members in one embodiment comprising inflatable pouches. The pneumatogenic members extend in a direction for a distance sufficient to substantially fit around the waist of a person and extend vertically substantially in the abdominal area. The pneumatogenic members are releasably joinable to one another by a first tube secured to and leading into the first pneumatogenic member, a second tube member being provided which leads into and is secured to the second pneumatogenic member. A releasable coupling is provided for releasably joining the first and second tube in a manner to form a condiut for the flow of gas between the first and second pneumatogenic members. An inflating device is operably connected to the first pneumatogenic member through a valve device for releasing gas into the tubes and the first and second pneumatogenic members. A strap is provided for connecting the ends of the first and second pneumatogenic members opposite the first and second tubes. In one embodiment, the strap for connecting the ends of the first and second pneumatogenic members comprises an adjustable strap such as a looped strap passing through rings to which the pneumatogenic members are secured, the ends of the looped strap being adjustably joinable through a buckle. The water safety belt is adapted to be worn around wading boots extending at least to the waist and to seal the boots to the waist of a person wearing them to prevent or minimize water flowing into such boots.

DETAILED DESCRIPTION

Figure 1:
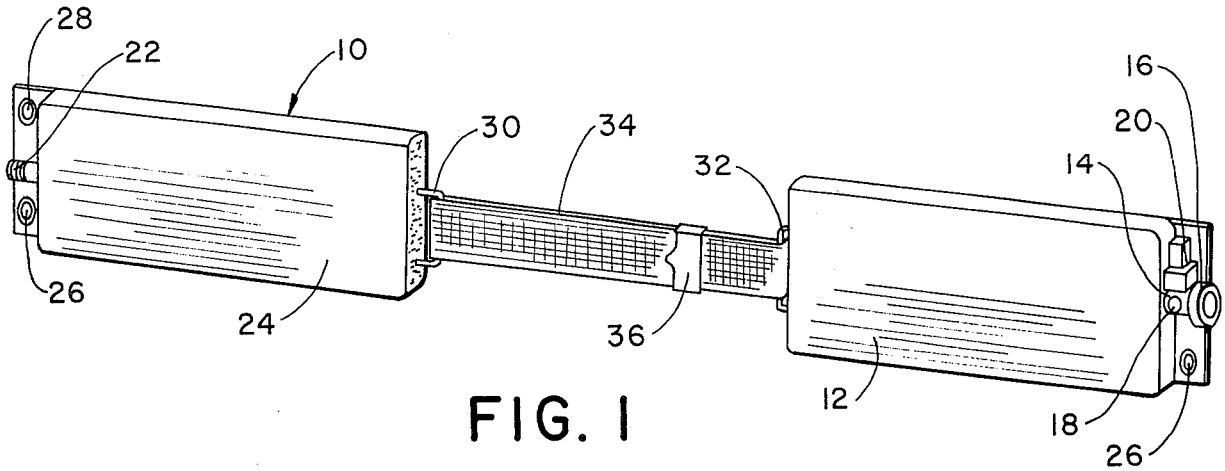
FIG. 1 illustrates a first perspective view of a water safety belt such as an adjustable flotation belt according to one embodiment of the present invention.

Water safety belts adapted to be worn around the waist are known in the prior art such as those described in U.S. Pats. Nos. 3,119,132 Nayar; 2,886,835 Moran; 2,760,212 Gazelle and 3,049,735 Baker. Inflatable belts such as those described in the Nayar, Moran and Gazelle references, once inflated are difficult to remove since the air bags when inflated tend to apply tightening pressure to the belt connectors holding these safety belts in place on the waist of a person. Furthermore, none of the foregoing references relating to inflatable belts teach means for deflating a belt after it is used. Water safety belts are also disclosed in U.S. Pats. Nos. 3,416,172 Gerling; 3,077,618 O'Link; 2,996,227 Andrew and 2,261,389 Kernchen.

It is therefore an object of the present invention to overcome these and other difficulties encountered in the prior art.

It is a further object of the present invention to provide a novel water safety belt especially an adjustable flotation belt.

It is another object of the present invention to provide a water safety belt that is inflatable and when disconnected after having been inflated will deflate.

It is a further object of the present invention to provide a novel water safety belt that is easily disconnected when inflated and in place around the waist of a person wearing such belt.

These and other objects have been achieved according to the present invention and will become apparent from the disclosure and claims that follow as well as the appended drawing.

Referring to FIGS. 1 through 4 of the drawing a water safety belt 10 and a water safety belt 100 are illustrated which are adapted to be worn around the waist of a person and comprise a first pneumatogenic member such as an inflatable pouch 12 or 112 and a second pneumatogenic member such as an inflatable pouch 24 or 124 extending in a horizontal direction for a distance sufficient to substantially fit around the waist of a person, the pneumatogenic members extending in a vertical direction for a distance substantially in the abdominal area of a person wearing the belt. The pneumatogenic members are releasably joinable to one another by a first tube member 14 and 114 secured to and leading into first pneumatogenic member 12 and 112 respectively and a second tube member 22 leading into second pneumatogenic member 24, a similar second tube being provided to lead into pneumatogenic member 122 this second tube not being shown. A releasable coupling 16 and 116 is provided for releasably joining the first and second tubes together in a manner to form a conduit for the flow of gas between the first and second pneumatogenic members. An inflation member is provided comprising a compressed gas container 20 and 120, this container in one embodiment being adapted to receive a compressed gas cylinder such as a carbon dioxide cylinder. A ring and chain 18 and 118 are provided for operating a valve in container 20 and 120 respectively and which controls the flow of gas into the first pneumatogenic member 12 or 112 and the first and second tubes as well as the second pneumatogenic member. A strap 34 or 134 is employed for connecting the ends of the first and second pneumatogenic members at ends opposite the first and second tubes, strap 34 or 134 being adjustable through buckle 36 or 136 which adjustably joins the ends of the strap 34 or 134. The water safety belt 10 illustrates one embodiment where the strap 34 is looped through rings 30 and 32 attached to the ends of pneumatogenic members 12 and 24 whereas water safety belt 100 illustrates a different embodiment wherein the pneumatogenic members 112 and 124 are secured to the strap 134 which runs horizontally on the inside of members 112 and 124. Mating fasteners such as snap fasteners 26 and 28 or 128 and 128 are attached to the ends of the pneumatogenic members and are releasably fastenable.

Figure 2:
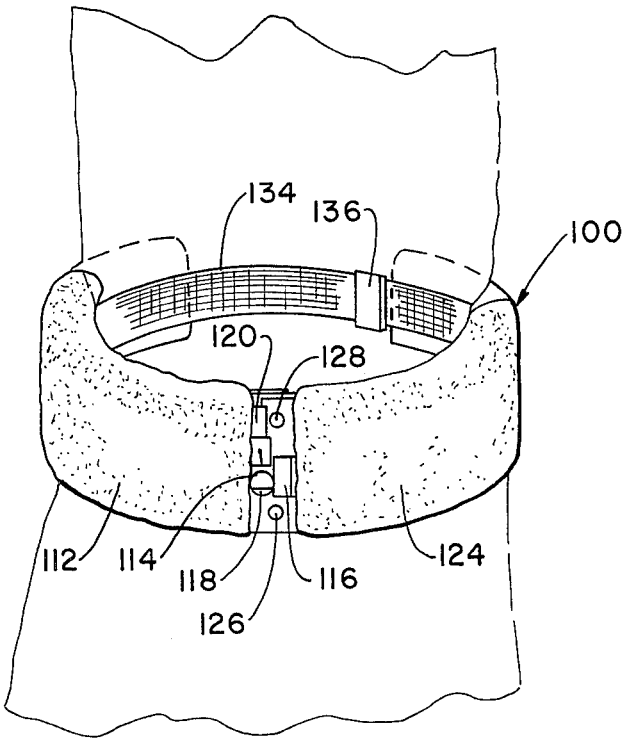
FIG. 2 illustrates a second perspective view of a water safety belt such as an adjustable flotation belt in place around the waist of a person according to another embodiment of the invention.
Figure 3:
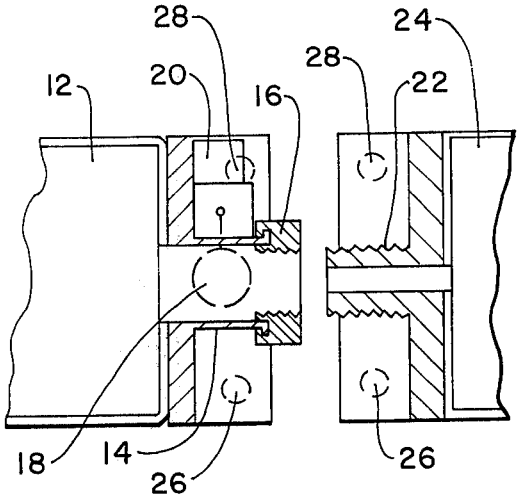
FIG. 3 illustrates a partial side elevation of a releasable belt securing member in section according to another embodiment of the present invention.
Figure 4:
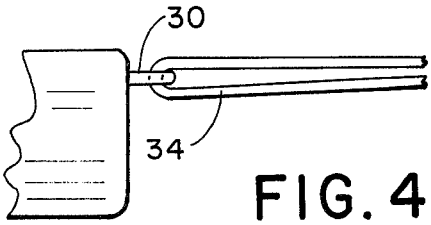
FIG. 4 illustrates a partial plan view of the adjustable strap employed in the belt illustrated in FIG. 1 according to another embodiment of the present invention.

In use, the belt 10 or 100 is worn around the waist by placing the belt in a position as illustrated in FIG. 2 and the collar 16 or 116 screwed onto tube 22 or its counterpart on the pneumatogenic member 124 until a gas tight seal and conduit is formed with the first tube 14 or 114, the collar and the second tubes. Fasteners 26 or 126 and 28 or 128 are joined and the water safety belt adjusted to fit comfortably and snugly by means of strap 34 or 134 and adjustable buckle 36 or 136. The valve in container 20 or 120 is operated by pulling ring 18 or 118 respectively and the pneumatogenic members are then filled with a gas that increases their buoyancy. When the water safety belt 10 or 100 is worn over a pair of one piece wading boots known in the art that are at least waist high the boots will be sealed against water entering then when the safety belt of the present invention is worn over the boots. This seal is improved when the belt is inflated since the inflatable pouches or pneumatogenic members expand upon being filled with a compressed gas. Inflation of the belt thus acts in two ways to assist in keeping a person buoyant when the belt is worn with the aforementioned wading boots; first, the belt improves buoyancy and second, it helps to prevent such boots from becoming filled with water which would tend to pull a person down who was wearing them. Upon removing the belt, the collar 16 or 116 is turned to uncouple the first and second tubes thereby not only disconnecting the ends of the inflatable pouches but also releasing the gas, if any from these pouches.

Although the invention has been described by reference to some embodiments, it is not intended that the novel water safety belt or adjustable flotation belt is limited thereby, but that modifications thereof are intended to be included as falling within the broad scope and spirit of the foregoing disclosure, the following claims and the appended drawing.

What is claimed is:

1. A water safety belt adapted to be worn around the waist of a person comprising first pneumatogenic means and second pneumatogenic means extending in a horizontal direction for a distance sufficient to substantially fit around the waist of a person, said first and second pneumatogenic means extending vertically for a distance substantially in the abdominal area, said first and second pneumatogenic means releasably joinable to one another by first tube means secured to and leading into said first pneumatogenic means and second tube means secured to and leading into said first pneumatogenic means, releasable coupling means for releasably joining said first and second tube means in a manner to form a conduit for the flow of a gas between said first and second pneumatogenic means, said releasable coupling means comprising collar means extending from the end of said first tube means and collar receiving means extending from the end of said second tube means, said collar means and said collar receiving means being adapted to couple to one another in order to hold said water safety belt around the waist of a person and to form a pneumatogenic seal, inflation means operably connected to said first pneumatogenic means through valve means for releasing gas into said tube means and said first and second pneumatogenic means, means for connecting the ends of said first and second pneumatogenic means opposite said first and second tube means.

2. The water safety belt of claim 1 where said first pneumatogenic means comprise first inflatable pouch means, and said second pneumatogenic means comprises second inflatable pouch means.

3. The water safety belt of claim 2 where said first tube means is secured to one end of said first inflatable pouch and said second tube means is secured to one end of said second inflatable pouch, strap means for connecting the ends of said first and second inflatable pouches opposite the ends where said first and second tube means are connected to said first and second pouches.

4. The water safety belt of claim 3 where said inflation means comprises compressed gas container means.

5. The water safety belt of claim 4 where said compressed gas container means comprises means adapted to receive compressed gas bottle means.

6. The water safety belt of claim 5 where said strap means comprises adjustable strap means.

7. The water safety belt of claim 6 where said strap is looped through ring means to form a looped strap means, the ends of said strap being joined by adjustable buckle means, said ring means secured to the ends of said first and second inflatable pouch means opposite said first and second tube means.

8. The water safety belt of claim 6 where said first and second inflatable pouches are mounted on strap means, each end of said strap being joined by adjustable buckle means.

9. The water safety belt of claim 7 which is adapted to be worn around wading boots extending at least to the waist and to seal said boots to the waist of a person wearing them to prevent water from entering such boots.

10. The water safety belt of claim 8 which is adapted to be worn around wading boots extending at least to the waist and to seal said boots to the waist of a person wearing them to prevent water from entering such boots.

* * * * *